United States Patent [19]

Haage et al.

[11] Patent Number: 5,076,374

[45] Date of Patent: Dec. 31, 1991

[54] DRILLING DEVICE WITH AN IMPACT-ROTATION TOOL

[75] Inventors: Manfred Haage, Dornstetten-Aach; Werner Heinzelmann, Freudenstadt, both of Fed. Rep. of Germany

[73] Assignee: fischerwerke Artur Fischer GmbH & Co. KG, Tumlingen/Waldachtal, Fed. Rep. of Germany

[21] Appl. No.: 605,120

[22] Filed: Oct. 26, 1990

[30] Foreign Application Priority Data

Oct. 28, 1989 [DE] Fed. Rep. of Germany ..... 3935985

[51] Int. Cl.[5] ..... E21C 37/04

[52] U.S. Cl. ..... 175/135; 299/23

[58] Field of Search ..... 175/135, 414; 299/23

[56] References Cited

U.S. PATENT DOCUMENTS 2,534,809 12/1950 Brown ..... 175/135
2,691,512 10/1954 Arizio ..... 299/23
4,474,410 10/1984 Ogaki et al. ..... 299/23

FOREIGN PATENT DOCUMENTS 306539 3/1989 European Pat. Off. ..... 299/23

*Primary Examiner*—William P. Neuder
*Attorney, Agent, or Firm*—Michael J. Striker

[57] ABSTRACT

The drilling device for memory, particularly aerated concrete, includes an impact drilling machine and an impact rotation tool to be clamped in the drilling machine. To prevent the impact-drilling shank jamming in the drill hole as it is withdrawn, and nevertheless to achieve maximum holding power in the masonry, the impact-rotation tool consists of an impact-drilling shank tapered conically toward a tip from a cylindrical middle portion of increased diameter, a carrier bush connected with a circumferential shoulder of the impact-drilling shank and a ram engaging with some play in an internal bore of the carrier bush. A drill bit-like locating means is provided on the ram for engagement in the drilling machine.

5 Claims, 1 Drawing Sheet

DRILLING DEVICE WITH AN IMPACT-ROTATION TOOL

BACKGROUND OF THE INVENTION

The invention relates to a drilling device with an impact-rotation tool producing drill holes in masonry consisting of aerated concrete or similar material. In operation, the impact rotation tool is clamped in an impact drilling machine or similar apparatus.

Drilling devices are known, in which, in particular to produce drill holes in aerated concrete or similar material, an impact shank is used instead of a drill bit. This impact shank is driven into the aerated concrete and thereby produces an exactly defined drill hole, the aerated concrete being compacted in the region of the drill hole at the same time. These known devices have the disadvantage that the impact shank becomes jammed in the drill hole and thus can be removed from it only with difficulty or not at all.

It is also known to use a rotary shank instead of a drill bit. When preparing the drill hole in aerated concrete or similar material the aerated concrete is compacted and displaced in the region of the drill hole. Rotary shanks disadvantageously widen the drill hole. In particular, the rotary movements carried out during the drilling operation in dry aerated concrete lead to the drill hole being reamed out. When producing corresponding drill holes in wet aerated concrete on the other hand, it happens frequently that a fixing plug cannot be inserted in the drill hole, since the latter is too small in comparison with the diameter of the fixing plug. Owing to the low strength of aerated concrete, however, relatively large diameters have to be used for approved fixing plugs to introduce the load. These fixing plugs are not suitable, however, for through mounting. On the other hand, expansible plugs with a relatively small degree of expansion cannot be used in aerated concrete since, when preparing the drill hole, the drill hole is widened through slight deviations from the drilling axis, resulting in the holding value of the fixing plug to be inserted being impaired.

The invention is based on the problem of producing a drilling device to prepare geometrically exactly defined drill holes in aerated concrete or similar material, which moreover permits the drilling device to be removed without difficulty from the drill hole, when the drilling operation has been completed.

According to the invention the drilling device includes an impact-rotation tool consisting of an impact-drilling shank, a carrier bush connected to the impact-drilling shank and a ram lying within the carrier bush. The ram is provided with a drill-bit like locating means for engagement in an impact drilling machine. In operation of the impact drilling machine, the ram with its drill bit-like locating means disengages from the carrier bush, when the impact drilling machine is switched on and drives the impact-drilling shank into the aerated concrete as a result of the impact energy produced by the impact drilling machine. As a result of the friction between the impact-drilling shank and the aerated concrete, rotation of the impact-drilling shank with the ram is prevented during the drilling of the hole, so that during the drilling operation it is only the ram mounted with clearance in the carrier bush that rotates. Through the advancement of the impact-drilling shank during the drilling operation, without this itself rotating, a reproduction of the shank in the form of an exactly defined drill hole is formed in the aerated concrete. Slight axial deviations during the drilling operation are accommodated by the play existing between the ram and the carrier bush. Larger deviations are not accommodated by alterations in the geometry of the drill hole itself, but are averted by the transverse force occurring in the aerated concrete on the impact-drilling shank, without which there would be a change in the drill hole.

When the required drill hole depth has been reached, the aerated concrete is compacted and displaced in the area of the impact-drilling shank introduced into it. The impact-drilling shank is prevented from becoming jammed in the compacted aerated concrete as the impact-drilling shank is being removed, since, as the impact-drilling shank is withdrawn from the drill hole, the ram becomes fixed in the conically formed carrier bush and thus the rotary movement of the ram is transferred by the carrier bush to the impact-drilling shank itself. The impact-drilling shank can therefore be removed from the drill hole without further force being applied.

An especially advantageous development of the invention provides for the impact-drilling shank to have a notch at its end opposite the end adjacent the ram, i.e. the end which engages the aerated concrete when drilling the hole. An additional safeguard against rotation of the impact-drilling shank as it is being driven into the aerated concrete is achieved by this shaping of the shank tip of the drilling device according to the invention.

A cylindrical portion is provided on the impact-drilling shank and has an increased diameter relative to the remainder of the shank. This increased diameter of the cylindrical portion of the shank in this region corresponds to the diameter of the fixing plug to be inserted subsequently in to the drill hole. By this means it is possible to obtain a drill hole of exact definition in this region, matched to the fixing plug to be inserted.

The conical shaping of the leading region of the leading region of the impact-drilling shank, which at the front end of the impact-drilling shank has a diameter of about 0.9×the nominal diameter of the fixing plug, facilitates the later removal of the impact-drilling shank from the drill hole, since a reduced friction with the wall of the drill hole is achieved by this.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE INVENTION

Figure 1:
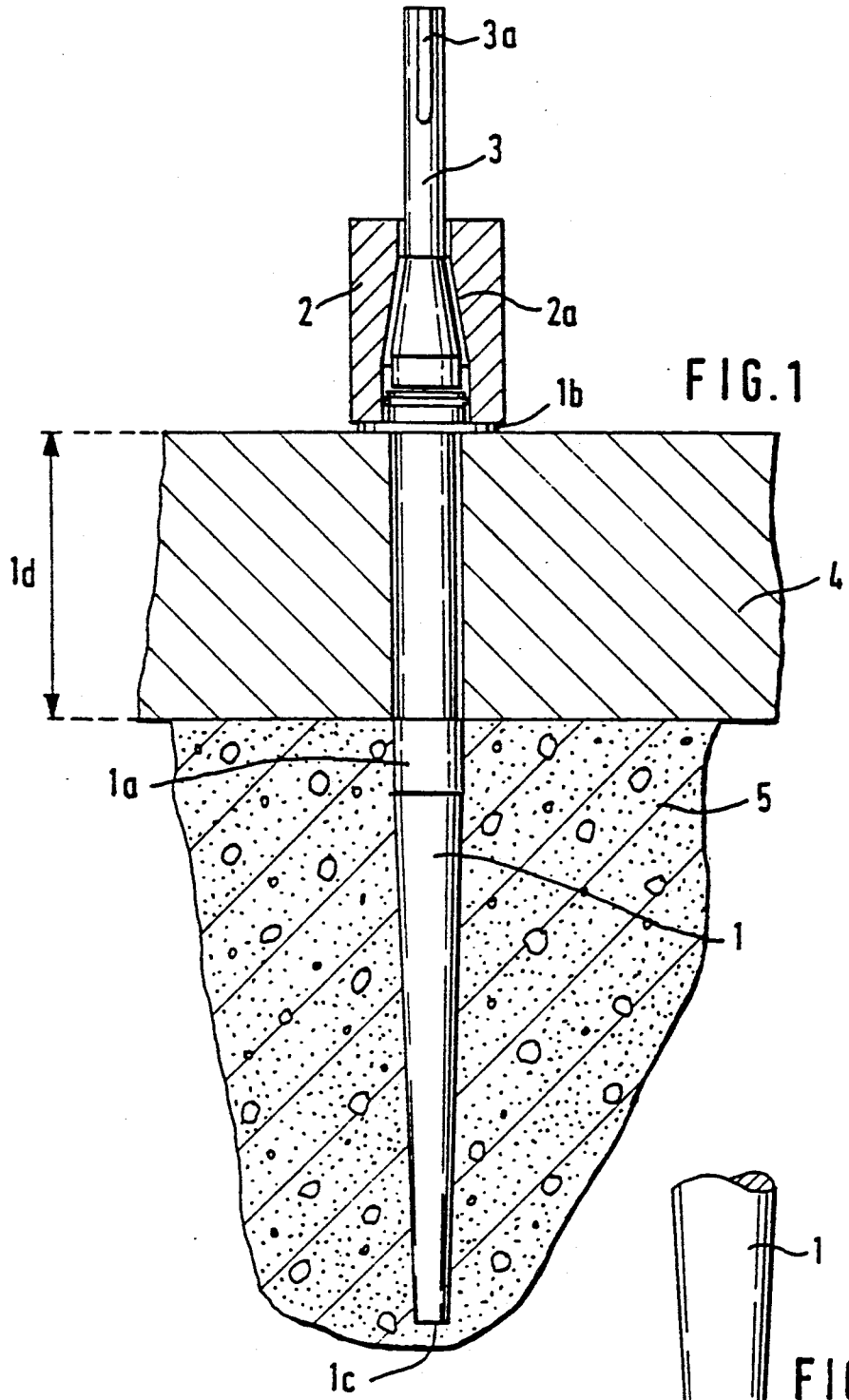
FIG. 1 is a cross sectional view through a drilling device according to the invention, the drilling device being driven through an object mounted on the aerated concrete masonry.

The drilling device shown in FIG. 1 includes an impact-drilling shank 1 and a carrier bush 2, to which the impact-drilling shank 1 is connected. A ram 3 is located in a conically shaped internal bore 2*a* of the carrier bush 2. The ram 3 and the bore 2*a* are such that there is clearance between the ram 3 and the bush 2. On a lateral face of the ram 3 there is a drill bit-like locating means 3a. A cylindrical portion 1a is provided in the middle region of the impact-drilling shank 1. At an end face adjacent the carrier bush 2 the impact-drilling shank 1 has a circumferential shoulder 1b extending around its circumference. The impact-drilling shank 1 tapers conically between its cylindrical portion 1a and another end face 1c at the end of the shank opposite to the ram 3. In the region between its shoulder 1b and the cylindrical portion 1a the impact-drilling shank 1 has a region 1d of a reduced diameter.

The impact-drilling shank 1 is inserted in the masonry of aerated concrete 5 through a mounted object 4. If a drill hole is to be prepared for a mounting, the drilling device according to the invention is inserted with the drill bit-like locating means 3a of the ram 3 into an impact drill, which has not been illustrated in the drawing. When the impact drill is switched on, the ram 3 disengages from the carrier bush 2 and as a result of the impact energy drives the impact-drilling shank 1 through the mounted item 4 into the aerated concrete 5. The friction between the impact-drilling shank 1 and the aerated concrete 5 prevents rotation of the impact-drilling shank 1 in the drill hole. It is only the ram 3 that rotates during the drilling operation. Once the required drill hole depth has been reached, the impact-drilling shank 1 has compacted and displaced the aerated concrete 5. To remove the impact-drilling shank 1 the impact drilling machine is withdrawn. The result of this is that, following the movement which, related to the drawing, is an upward movement, the ram 3 becomes fixed in the conically shaped internal bore 2a of the carrier bush 2. The carrier bush 2 therefore transfers the rotary movement of the ram 3 to the impact-drilling shank 1, since this is connected to the carrier bush 2 by the shoulder 1b. In this manner the impact-drilling shank 1 is removed from the drill hole. Jamming of the impact-drilling shank in the mounted object 4 during the withdrawal is prevented because of the region 1d of reduced diameter and jamming in the aerated concrete 5 is prevented by the tapered shaping of the impact-drilling shank 1.

Figure 2:
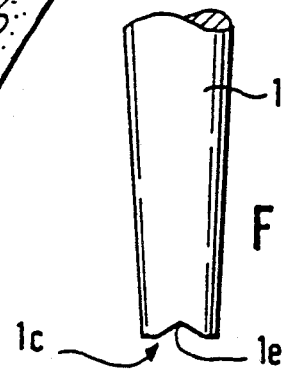
FIG. 2 is a cutway cross sectional view of a portion of the impact-drilling shank of another embodiment of the drilling device according to the invention.

FIG. 2 illustrates a further embodiment of the impact-drilling shank 1. At the other end face 1c of the shank there is a notch 1e which provides an additional safeguard against rotation at the other end face 1c during the drilling operation.

It will be understood that each of the elements described above, or two or more together, may also find a useful application in other types of structures differing from the types described above.

While the invention has been illustrated and described as embodied in a drilling device with an impact-rotation tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. In a drilling device for producing a drill hole in masonry including aerated concrete, said drilling device comprising an impact drilling machine and an impact rotation tool, the impact-rotation tool being arranged to be clamped in the impact drilling machine, the improvement wherein said impact-rotation tool consists of an impact-drilling shank, a carrier bush connected with the impact-drilling shank, said carrier bush having an internal bore that widens conically toward the impact-drilling shank, and a ram engaging in the carrier bush, said ram widening conically toward the impact-drilling shank in a region of said ram adjacent the impact-drilling shank and being provided with a drill bit-like locating means.

2. The improvement as defined in claim 1, wherein the impact-drilling shank has a circumferential shoulder connected to an end face of the carrier bush adjacent said shoulder, said circumferential shoulder extending around the circumference of the impact-drilling shank.

3. The improvement as defined in claim 1, wherein the impact-drilling shank has another end face remote from the ram and said other end face remote from the ram is provided with a notch.

4. The improvement as defined in claim 1, wherein the impact-drilling shank is provided with a cylindrical portion of increased diameter in a middle region of the impact-drilling shank.

5. The improvement as defined in claim 4, wherein the impact-drilling shank tapers conically from said other end face remote from the ram to said cylindrical portion and said cylindrical portion extends to an end face adjacent the ram.

* * * * *